US007038169B2

(12) United States Patent
Dittmar et al.

(10) Patent No.: US 7,038,169 B2
(45) Date of Patent: May 2, 2006

(54) ELECTRIC HEATER FOR THE COUPLING HEAD OF A CENTRAL BUFFER COUPLING

(75) Inventors: Goetz Dittmar, Salzgitter (DE); Dirk Behrens, Halberstadt (DE)

(73) Assignee: Voith Turbo Scharfenberg GmbH & Co. KG, Salzgitter (DE)

( * ) Notice: Subject to any disclaimer, the term of this patent is extended or adjusted under 35 U.S.C. 154(b) by 0 days.

(21) Appl. No.: 10/242,384

(22) Filed: Sep. 12, 2002

(65) Prior Publication Data

US 2003/0047547 A1 Mar. 13, 2003

(30) Foreign Application Priority Data

Sep. 12, 2001 (DE) ..... 101 44 838

(51) Int. Cl.
*H05B 3/00* (2006.01)
*B61G 1/00* (2006.01)
*B61G 5/00* (2006.01)

(52) U.S. Cl. ..... 219/201; 219/520; 219/535; 219/544; 213/75 R

(58) Field of Classification Search ..... 219/201, 219/520, 535, 544, 540, 530, 536; 213/75 R, 213/77, 220, 221–222
See application file for complete search history.

(56) References Cited

U.S. PATENT DOCUMENTS

| | | | | |
|---|---|---|---|---|
| 3,335,459 | A * | 8/1967 | Tyrner | 219/544 |
| 3,412,231 | A * | 11/1968 | McElligott | 219/521 |
| 3,499,189 | A * | 3/1970 | Perras | 219/530 |
| 3,542,123 | A * | 11/1970 | Hornbaker et al. | 219/516 |
| 3,723,705 | A * | 3/1973 | Province | 219/243 |
| 3,937,923 | A * | 2/1976 | Smith | 219/201 |
| 4,195,755 | A * | 4/1980 | Slautterback et al. | 222/146.5 |
| 4,208,574 | A * | 6/1980 | Schafer | 219/539 |
| 4,859,833 | A * | 8/1989 | Petersen | 219/432 |
| 5,580,275 | A * | 12/1996 | Bozek | 439/577 |
| 6,003,971 | A * | 12/1999 | Hanks et al. | 392/441 |
| 6,008,472 | A * | 12/1999 | Kreher et al. | 219/202 |
| 6,169,272 | B1 * | 1/2001 | Racine et al. | 219/424 |

* cited by examiner

*Primary Examiner*—John A. Jeffery
(74) *Attorney, Agent, or Firm*—Faier & Faier P.C.; James Faier; Martin Faier

(57) ABSTRACT

The invention relates to a heater for an electric central buffer coupling in which at least one heating element (3) is placed in a recess of the coupling head (1) and is covered toward the outside. To improve the transfer of heat from the heating element (3) into the coupling head (1) and to reduce the expense of assembling and dismantling the heating element (3), the recess is precision fitted to the diameter of the heating element (3) and the recess is constructed in such a way that after completion of the recess the heating element (3), including its seal to the front side, can be introduced into the recess and is to be removably affixed to the coupling head (1).

3 Claims, 1 Drawing Sheet

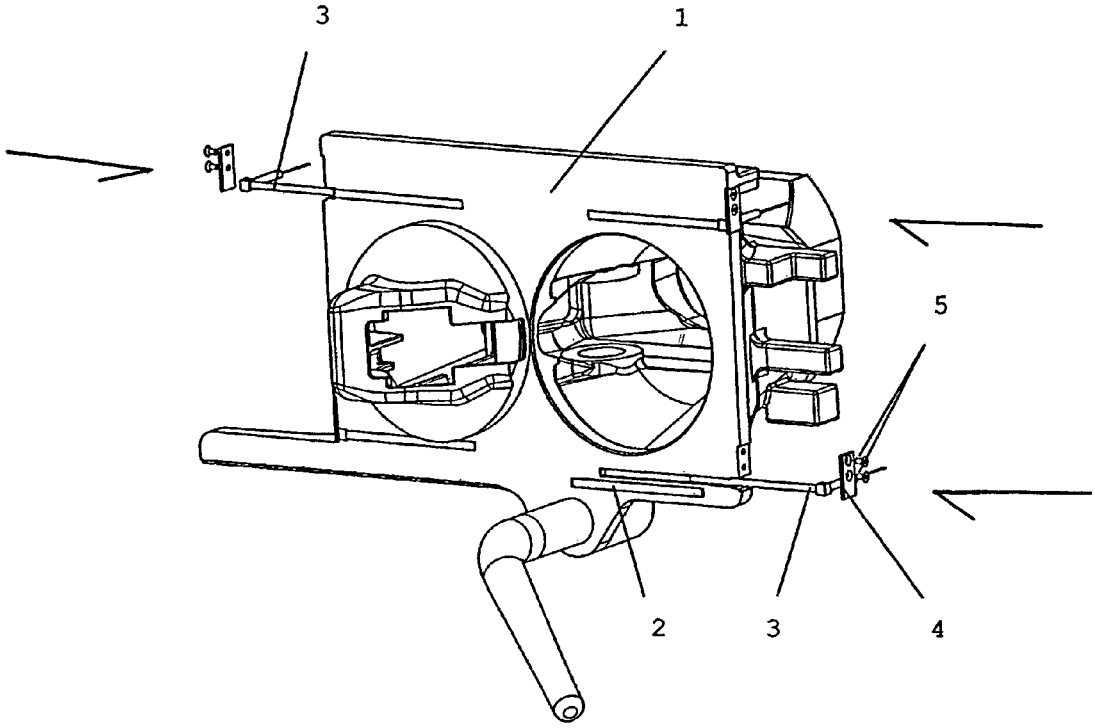
3
1
5
2
3
4

ELECTRIC HEATER FOR THE COUPLING HEAD OF A CENTRAL BUFFER COUPLING

The invention relates to an electric heater for the coupling head of a central buffer coupling in accordance with the generic part of this invention.

BACKGROUND OF THE INVENTION

Central buffer couplings have been used in series ET 420 urban railway multiple units in which an approximately semicircular channel, in which the electric heater is installed, is made in the buffer surface of the coupling head in the area of the centering ball and the inlet funnel. The heating element is intended to keep the face surface and coupling mechanism free of ice and snow in the winter and ensure the coupling function. The channel is sealed toward the outside by a hard solder, which forms a part of the buffer surface. Only low-melting-point hard solders, such as expensive silver solders, can be used as hard solders, because there is a risk of damaging the heating element at high processing temperatures. The use of soft solders with low melting points proved to be unsuitable because the melting temperature of the soft solder could be reached at the necessary heat output. When soldering in the heating element, there is always the risk of local overheating and resulting destruction of the heating element before placement into service. In addition, soldering in the heater without cavities in the filling material can be ensured only with considerable cost. In the cavities to be avoided, there may be local overheating of the heater on the one hand, or moisture can penetrate during operation, which leads to corrosion.

Further, it is prior art to cover the channel in the faceplate, in which the heating element is placed, toward the outside by welded-in or soldered-in cover sheets. As a result of the increased addition of heat during welding or soldering, a possible distortion or change in the material characteristics of both the cover sheet and the faceplate must be paid attention to and taken into consideration. Because the channel is made much wider than the diameter of the heating element for assembly reasons, there are undefined positionings of the heating element on the inside of the channel, which can lead to heat accumulation and overheating and consequently to destruction of the heating element. In addition to potential damage of the installed heating element by the welding/soldering process itself, in the cavity for the heating element there is always the risk of the penetration of moisture and the resulting destruction of the heater.

An electric heater for central buffer couplings, whose heating element in the channel is filled with a silicon material that forms the outside covering and that is a free-flowing single-component material during filling which cross-links and hardens under the influence of humidity in the air at room temperature, is known from DE 296 11 148 U. Due to the relatively poor heat conduction $\lambda=0.21$ W/(m×K) and the poor temperature resistance of the elastic casting compounds that were previously available and used, overheating of the heating element can occur which leads to destruction of the casting compound and consequently to destruction of the heating element. In addition, with the low surface strength of such casting compounds, there is the risk of penetration of foreign bodies and therefore of mechanical damage to the heating element.

Another disadvantage of the aforementioned designs is that replacing defective heating elements, since coiled tubing heating elements are generally used, is possible only by costly separation of the soldering seams or casting compound in the manufacturing plant or at a workshop. After replacing defective heating elements, the systems that are used must again undergo costly manufacturing by further soldering/welding or casting.

Therefore, the aim of the invention is to construct an electric heater for the coupling head of a central coupling buffer in such a way that the transfer of heat from the heating element into the coupling head is improved and the expense of assembly and disassembly of the heating element is reduced.

SUMMARY OF THE INVENTION

That aim of constructing an improved electric heater for the coupling head of a central coupling is fulfilled by the heater described in this application.

Useful developments of the invention are indicated in the subclaims.

As a result of the precise formation and coordination of the recess to the diameter of the heating element, quick and even heat conduction into the coupling head is guaranteed. In addition, installation of the heating element into the recess after mechanical completion of the coupling head, including the covering on the face, considerably reduces the risk of damage to the heating element, including its supply line. The claimed removable fastening ensures simple assembly and disassembly of the heating element.

The formation of the recess in accordance with this invention represents the preferred embodiment, which is based on previously preferred production methods.

An alternative embodiment for the formation of the recess is also presented in this invention.

The recess either being oriented substantially parallel to the faceplate of the coupling head or linear in accordance with this invention provides on the one hand useful positioning and on the other hand a beneficial geometric design that guarantees rapid heat conduction into the face of the coupling head.

The feature in accordance with this invention wherein the recess extends from the edge of the coupling head towards the inside of said head facilitates simple placement of the heating element into the coupling head after its mechanical completion.

The features of this invention that provides for heating elements disposed from both the right and left edges of the faceplate toward the inside of said faceplate or under the coupling bodies penetrating said faceplate promote quick and even heat conduction and distribution into the coupling head, particularly into said faceplate, which reduces thawing times.

By using removable fasteners for affixing the element to the coupling head in accordance with this invention, quick assembly and disassembly guarantee rapid installation, removal, and replacement of a defective heating element, which also helps to achieve shorter down times for vehicles when replacing the heating element.

BRIEF DESCRIPTION OF THE DRAWING

The FIGURE shows a preferred embodiment of the invention.

DETAILED DESCRIPTION OF A PREFERRED EMBODIMENT

The invention is described in greater detail below based on an embodiment in reference to the drawing, in which FIGURE shows a perspective view of an electric heater for a central buffer coupling with heating elements that are installed and intended for installation.

Recesses in the form of channels are disposed in the faceplate of coupling head 1 of a central buffer coupling shown in FIGURE. The channels made in the faceplate in different orientations and at different distance dimensions are coverable or covered toward the front in the plane of the faceplate closure by face sheets 2. Face sheets 2 are placed in appropriate indentations and connected to the faceplate, preferably by hard soldering. The resulting recess/channels are intended to receive heating elements 3 and are precisely matched to each other with regard to their diameter dimension Each heating element 3 is fastenable after installation through a holding sheet 4 on coupling head 1 by means of removable fastening means 5 and therefore able to be assembled and disassembled The important thing is that sensitive heating element 3 can still be installed after insertion of faceplate 2 in the coupling body, which considerably reduces the risk of damaging installed heating element 3 and its lines during the process of producing the central buffer coupling.

As described above, the recesses are preferably formed as a channel in the faceplate, which is then covered by means of an inserted face sheet 2. However, the recesses may be formed as a bore hole, which eliminates the insertion of face sheets 2 but does resolve not-inconsiderable problems when removing shavings and drilling in hardened and tempered steels.

The recesses are preferably linear and substantially parallel to the faceplate of coupling head 1.

The recesses extend from the edges of coupling head 1, particularly the faceplate, toward the inside.

It is advantageous for at least one recess each, into which one heating element 3 each is plugged and removably affixed on coupling head 1, to extend from the left and right edge of the faceplate toward the inside.

In a preferred embodiment of the invention, two recesses each are disposed from the left and right edge of the faceplate toward the inside to receive one heating element each. In that regard, one recess on each side is above and the other recess is below the connecting bodies penetrating the faceplate, such as centering devices, centering elements, closures, connecting eyes, inlet funnel/inlet opening, etc. Rod-shaped high-performance cartridges are preferably used as heating elements 3.

According to the state of the art, coiled tubing heating elements in various shapes in different lengths and dimensions have been placed in channels, and the channels generally were not linear, at least in certain areas. The channel width is about twice as large as the heating element due to dimensional tolerances when bending the coiled tubing heating elements. The present use of coordinated, precision-fitted diameters of the recess avoids undefined, unsupported positionings of the heating element in the recess and local heat conduction values that differ considerably from each other. A linear design of the heating element and the recess receiving it facilitates or allows the installation of heating elements after mechanical completion of the coupling head. The provided removable fastening of heating element 3 allows quick assembly and disassembly.

What is claimed is:

1. A coupling head comprising a faceplate and at least one linear heating element in a linear recess in the coupling head, wherein the recess extends from an edge of the coupling head into the coupling head substantially parallel to the faceplate and is precisely fitted to the heating element, and wherein each heating element is capable of being removably affixed to the coupling head, wherein two recesses are disposed in each of opposing horizontal edges of the faceplate, wherein one recess on each side is disposed over coupling bodies penetrating the faceplate and each remaining recess is disposed under coupling bodies penetrating the faceplate.

2. A coupling head comprising a faceplate and at least one linear heating element in a linear recess in the coupling head, wherein the recess extends from an edge of the coupling head into the coupling head substantially parallel to the faceplate and is precisely fitted to the heating element, and wherein each heating element is capable of being removably affixed to the coupling head, wherein two recesses are disposed in each of opposing horizontal edges of the faceplate, wherein one recess on each side is disposed over coupling bodies penetrating the faceplate and each remaining recess is disposed under coupling bodies penetrating the faceplate, and wherein the at least one heating element further comprises an end having a holding sheet through which the heating element is affixed on said coupling head.

3. A heated central buffer coupling made by the process comprising:

providing a coupling head having a faceplate;

defining at least one linear channel on a surface of the faceplate from an edge of the coupling head;

covering the linear channel along the face plate with a face sheet to define a recess; and removably affixing a linear heating element in to the recess, wherein the recess is precisely fitted to the heating element, and wherein two recesses are disposed in each of opposing horizontal edges of the faceplate, wherein one recess on each side is disposed over coupling bodies penetrating the faceplate and each remaining recess is disposed under coupling bodies penetrating the faceplate.

* * * * *